US012673762B2

(12) United States Patent
Wang

(10) Patent No.: US 12,673,762 B2
(45) Date of Patent: Jul. 7, 2026

(54) POWER STEERING DEVICE FOR INFLATABLE BOAT

(71) Applicant: Boluo Futian Fumao plastic hardware products Co., Ltd., Guangdong Province (CN)

(72) Inventor: Qihao Wang, Guangdong Province (CN)

(73) Assignee: Boluo Futian Fumao plastic hardware products Co., Ltd., Guangdong Province (CN)

( * ) Notice: Subject to any disclaimer, the term of this patent is extended or adjusted under 35 U.S.C. 154(b) by 451 days.

(21) Appl. No.: 18/459,799

(22) Filed: Sep. 1, 2023

(65) Prior Publication Data

US 2024/0300634 A1 Sep. 12, 2024

(30) Foreign Application Priority Data

Mar. 8, 2023 (CN) ..... 202320423648.4

(51) Int. Cl.
*B63H 25/10* (2006.01)
*B63B 7/08* (2020.01)
*B63H 25/38* (2006.01)

(52) U.S. Cl.
CPC ..... *B63H 25/10* (2013.01); *B63B 7/085* (2013.01); *B63H 25/38* (2013.01)

(58) Field of Classification Search
CPC ..... B63H 25/10; B63H 25/38; B63B 7/085
See application file for complete search history.

(56) References Cited

U.S. PATENT DOCUMENTS 2,323,261 A * 6/1943 Vigo ..... B63H 16/12 280/282
3,913,159 A * 10/1975 Thomas ..... B63H 25/08 441/132
D320,922 S * 10/1991 Lurkis ..... 74/551.9
6,332,735 B1 * 12/2001 Wang ..... B62K 21/06 280/279
2003/0084759 A1 * 5/2003 Carini ..... B25G 1/046 81/492
2006/0057906 A1 * 3/2006 Song ..... B63H 25/38 440/22
2006/0185574 A1 8/2006 Levesque

FOREIGN PATENT DOCUMENTS

WO 2006072877 A1 7/2006

* cited by examiner

*Primary Examiner* — Stephen P Avila

(57) ABSTRACT

A power steering device for inflatable boat includes a boat body, an underwater propeller is fixed on one side of the bottom surface of the boat body, a rudder is arranged on the other side of the bottom surface of the boat body, and a swinging handle is provided on the top surface of the boat body, a swinging joint is fixed to one end of the swinging handle, and the swinging joint and the swinging handle are connected by a connection mechanism, the boat body is provided with a mounting hole passed through the boat body, and the rudder and the swinging joint are respectively mounted two openings of the mounting hole, and the rudder is fixed to the swinging joint so as to rotate synchronously.

6 Claims, 7 Drawing Sheets

POWER STEERING DEVICE FOR INFLATABLE BOAT

FIELD OF THE INVENTION

The present invention relates to the technical field of Inflatable boat, more particularly, to a power steering device for inflatable boat.

BACKGROUND OF THE INVENTION

Inflatable boat is an air-filled ship and mostly made of rubber, is also referred to as a rubber ship, which can be compressed without being inflated, and is driven by a motor or human power. Inflatable boat can be used for purposes such as recreational games and water rescue, and is also widely applied to occasions such as tourism, drift, sports competition, military exploration, fishing, hunting, etc., and can complete various water engineering works, flood prevention and rescue, and marine rescue, etc. Inflatable boat used for recreational games and water rescue, such as a gas-filled fishing boat, an outboard aircraft gas-filled boat, a gas-filled drift boat, or a gas-filled sharpened boat, has a gas-filled hull steering device, used for hull steering.

The existing gas-filled hull steering device has the defects of a complex structure and inconvenient operation, and has a relatively large resistance against water, thus affecting the power of the inflatable boat, resulting in a power loss of the inflatable boat, and resulting in a waste of energy resources.

SUMMARY OF THE INVENTION

The object of the present invention is to provide a power steering device for inflatable boat to solve the defects of the existing steering device for the inflatable boat aforementioned in the background.

In order to achieve the aforementioned object, the present invention provides the following technical solutions: a power steering device for inflatable boat includes an boat body, an underwater propeller is fixed on one side of the bottom surface of the boat body, a rudder is arranged on the other side of the bottom surface of the boat body, and a swinging handle is provided on the top surface of the boat body, a swinging joint is fixed to one end of the swinging handle, and the swinging joint and the swinging handle are connected by a connection mechanism, the boat body is provided with a mounting hole passed through the boat body, and the rudder and the swinging joint are respectively mounted the two openings of the mounting hole, and the rudder is fixed to the swinging joint so as to rotate synchronously.

The rudder and the swing joint are fixed by a mounting mechanism arranged at the mounting hole, the mounting mechanism includes a mounting cylinder, a first flange and a second flange; the first flange is mounted in the opening of the mounting hole on the top surface of the boat body, and the second flange is mounted in the opening of the mounting hole on the bottom surface of the boat body; the mounting tube are also fixed in the mounting hole, both end of the mounting tube are respectively inserted into the first flange and the second flange; the bottom of the swing joint is provided with a plug-in rod, the top of the rudder is provided with a mating tube; the mating tube is inserted into the mounting tube, the plug-in rod is inserted into the mating tube, the plug-in rod and the mating tube are in disassembly fixed connection.

Specifically, the outer wall of the plug-in rod is provided with several grooves, the inner wall of the mating tube is provided with several ribs, each of the ribs contains in one of the grooves to cooperate with each other.

The size of the first flange is the same as the that of the second flange.

The connection mechanism includes a first connecting hole, a second connecting hole, a screw and a nut, the first connecting hole is arranged at the first end of the swinging handle, the second connecting hole passes through the swinging joint; the swinging joint is provided with a mounting slot cooperated with the first end of the swinging handle, the mounting slot divides the second connecting hole into two separated parts; the connecting screw passes through a part of the second connecting hole, the first connecting hole and the other part of the second connecting hole, thereby fixing the swing handle and the swing connector.

The hole diameter of the first connecting hole is the same as that of the second connecting hole, the diameter of the nut is greater than the hole diameter of the first connecting hole.

The first end of the swinging handle is tightly attached to the groove wall of the mounting groove, and the swinging handle is rotated to drive the swinging joint to rotate synchronously.

The second end of the swinging handle is fixed with a handle.

The surface of the swinging handle is provided with anti-slip patterns.

Compared with the existing technology, the beneficial effects of this present invention are as follows:

In the present invention, the swing joint drives the first flange and the second flange to rotate, thereby changing the direction of the rudder. The rudder swings left and right, that is, the rudder can be switched at a water dividing angle, thereby guaranteeing the balance and security, and reducing the water resistance. The device has a simple structure, is easy to operate, reduces the power loss of the inflatable boat, and achieves the purpose of saving energy for the inflatable boat.

BRIEF DESCRIPTION OF THE DRAWINGS

In order to more clearly illustrate the technical schemes in the embodiments in the present invention, the drawings needed in the embodiments or the prior technical description are simple introduced below, obviously, the drawings described below are only some embodiments in the present invention, and for those skilled in the art, additional drawings may be obtained without creative labor.

Figure 1:
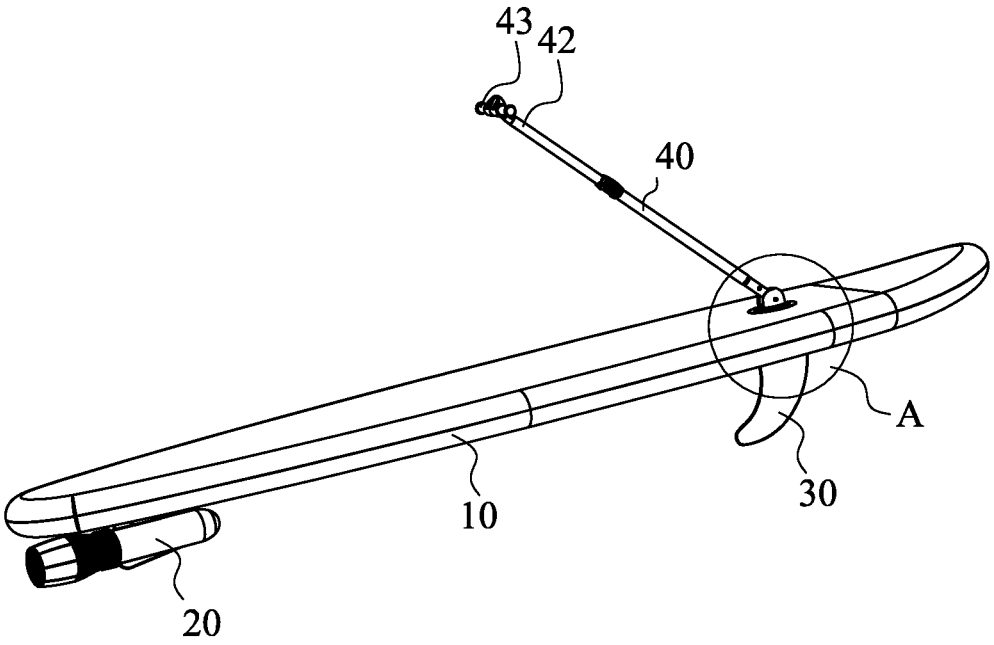
FIG. 1 is a perspective view of the power steering device for inflatable boat according to an embodiment of the present invention.
Figure 2:
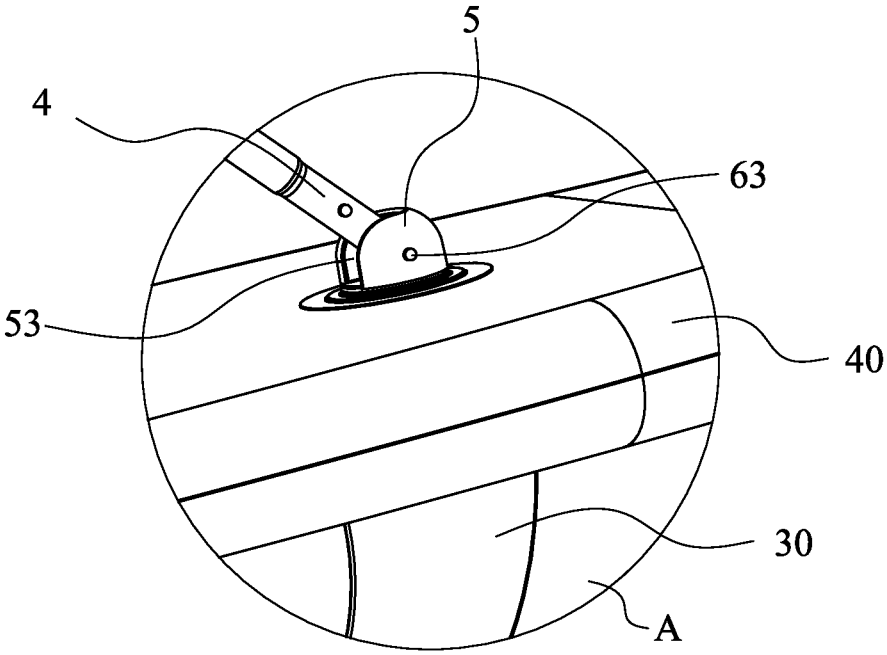
FIG. 2 is an enlarged view of portion A of FIG. 1.
Figure 3:
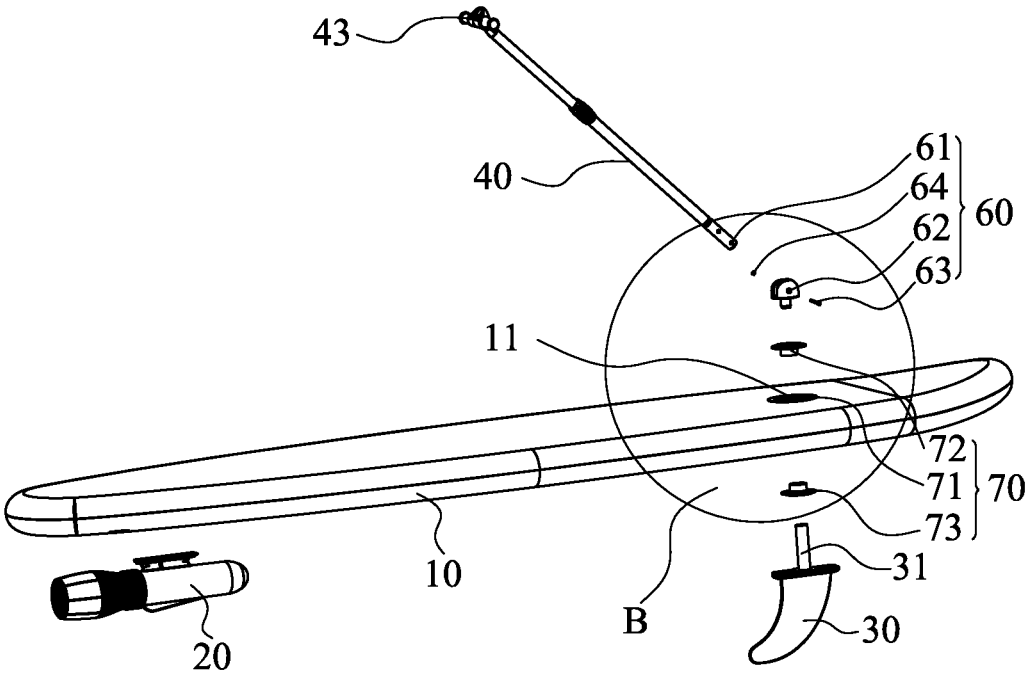
FIG. 3 is an exploded view of the power steering device for inflatable boat according to an embodiment of the present invention.
Figure 4:
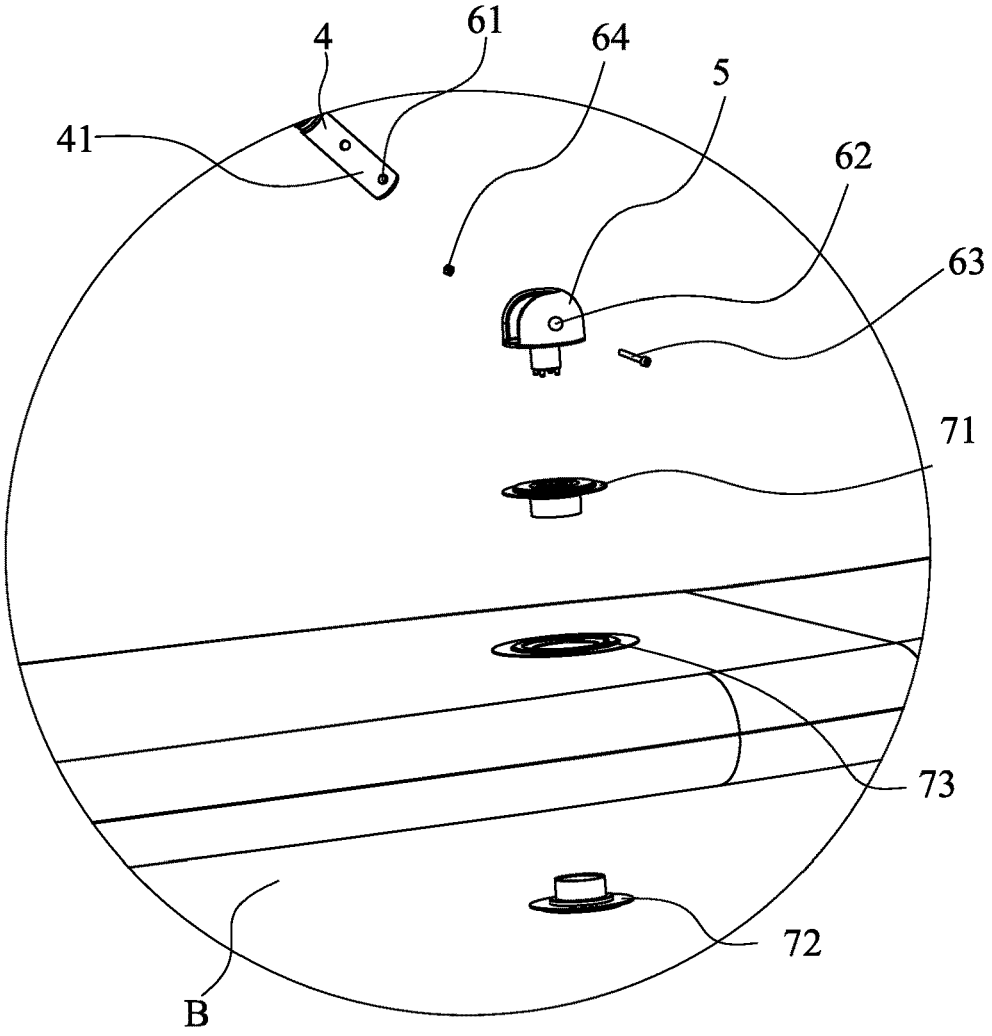
FIG. 4 is an enlarged view of portion B of FIG. 3.
Figure 5:
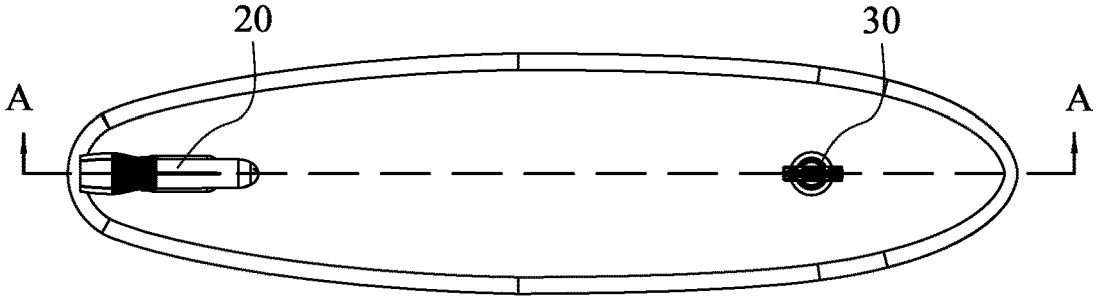
FIG. 5 is a bottom view of the power steering device for inflatable boat according to an embodiment of the present invention.
Figure 6:
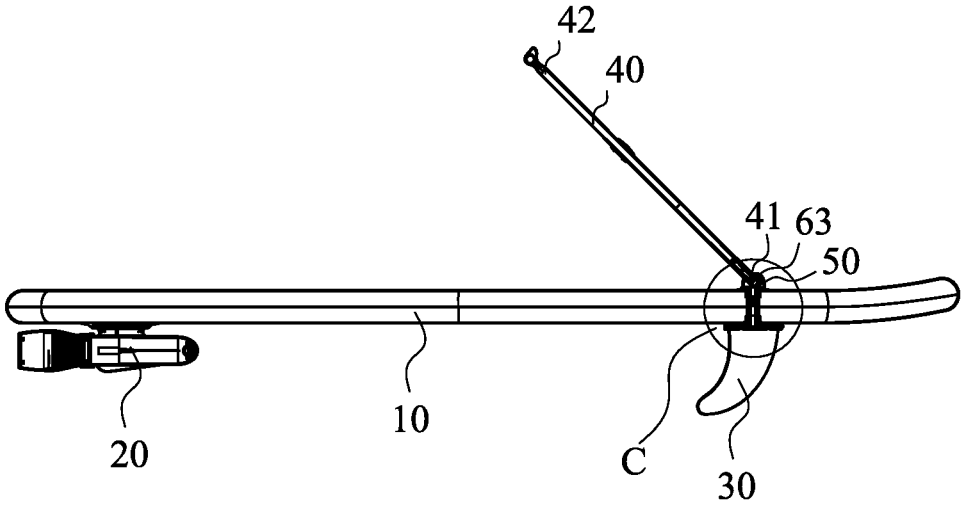
FIG. 6 is an in-section view along A-A line of FIG. 6.
Figure 7:
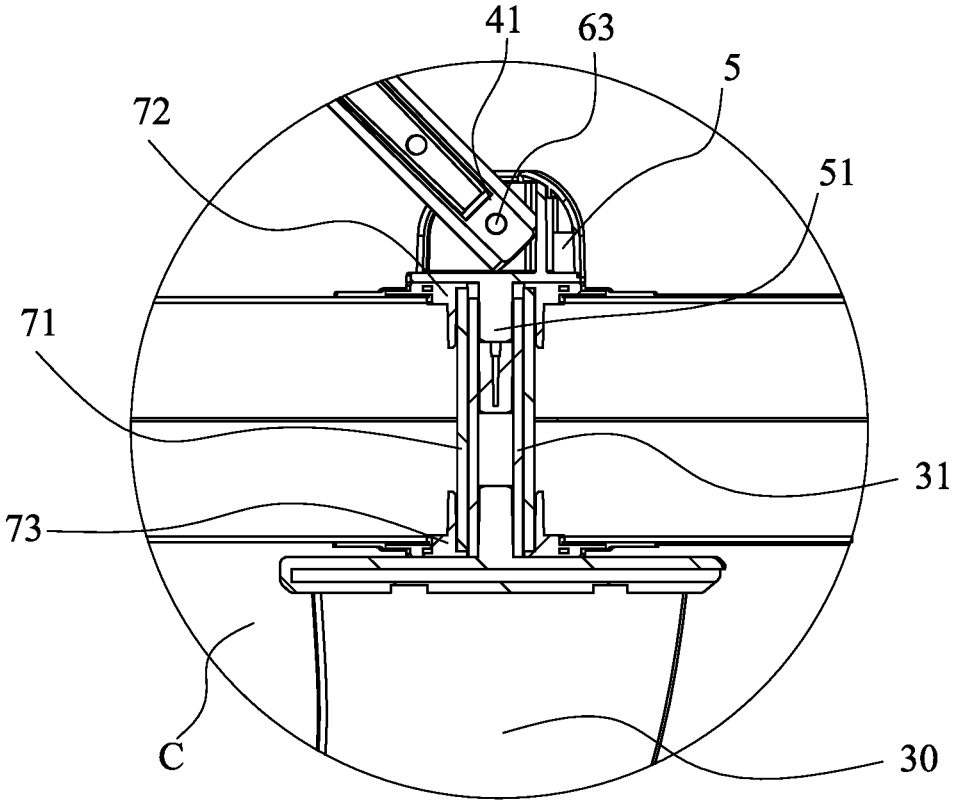
FIG. 7 is an enlarged view of portion C of FIG. 6.

The reference Numbers are as follows:

| | |
|---|---|
| 10. the boat body; | 11. the mounting hole; |
| 12. the handle; | 20. the underwater propeller; |
| 30. the rudder; | 31. the mating tube; |
| 40. the swinging handle; | 41. the first end; |
| 42. the second end; | 50. the swinging joint; |
| 51. the plug-in rod 51; | 60. the connection mechanism; |
| 61. the first connecting hole; | 62. the second connecting hole; |
| 63. the screw; | 64. the cap; |
| 70. the mounting mechanism; | 71. the mounting cylinder; |
| 72. the first flange; | 73. the second flange. |

EMBODIMENTS

Embodiments of the present invention are described in detail below, and examples of the embodiments are shown in the attached drawings, in which the same or similar labels represent the same or similar elements or elements with the same or similar function. The embodiments described below by reference to the attached drawings are exemplary and are intended to explain embodiments of the present invention and cannot be understood as limits in the present invention.

In the description of the embodiments of the present invention, it should be understood that if the embodiments involve directional indications, such as the "upper", "lower", "left", "right", "front", "rear", "internal" and "external", etc. indicating orientation or location relationship, is based on the orientation or position relationship shown in the figures, it is only for describing the embodiments in the present invention and simplifying the description, rather than indicating or implying the device or the element that must have a specified azimuth, constructed and operated, it cannot be understood as a limitation on the present invention.

Further, the terms "first", and "second" are used only for description purposes, and cannot be understood as indicating or implying relative importance or implicitly indicating the number of technical features indicated. Thus, features defining "first" and "second" may expressly or implicitly include one or more of the features. In the description of the embodiments of the present invention, the "plurality of" means two or more unless otherwise specifically limited.

In the embodiments of the present invention, unless otherwise specified and defined, the terms "installation", "connection", "connection", "fixation" and other terms shall be understood in a broad sense, for example, they can be fixed connection, detachable connection, or integrated; It may be a mechanical connection or an electrical connection; It can be directly connected or indirectly connected through an intermediate medium. It can be the connection between two elements or the interaction between two elements. For those skilled in the art, the specific meanings of the above terms in the embodiments of the present invention can be understood according to specific circumstances.

Referring to FIGS. 1-7, a power steering device for an inflatable boat includes a boat body 10, an underwater propeller 20 is fixed on one side of the bottom surface of the boat body 10, a rudder 30 is arranged on the other side of the bottom surface of the boat body 10, and a swinging handle 40 is provided on the top surface of the boat body 10, a swinging joint 50 is fixed to one end of the swinging handle 40, and the swinging joint 50 and the swinging handle 40 are connected by a connection mechanism 60, the boat body 10 is provided with a mounting hole 11 passed through the boat body 10. The rudder 30 and the swinging joint 50 are respectively mounted the two openings of the mounting hole 11, and the rudder 30 is fixed to the swinging joint 50 so as to rotate synchronously. The inflatable boat floats in water, for example, is placed in a river, a lake or a sea, the swing handle 40 is pushed to rotate, the swing joint 50 and the rudder 30 are driven to synchronously rotate, and the rudder 30 displaces water waves, thereby changing the direction of the inflatable boat. When the underwater propeller 20 operates, the inflatable boat is pushed to travel in the water, and at this time, the swing handle 40 is pushed to rotate to drive the rudder 30 to synchronously rotate, and the water wave is pushed to achieve the steering direction of the inflatable boat in travel.

Preferably, the rudder 30 and the swing joint 50 are fixed by a mounting mechanism 70 so as to enable the two rotate synchronously. Specifically, the in an embodiment in the present invention, the mounting mechanism 70 is arranged at the mounting hole 11. The mounting mechanism 70 includes a mounting cylinder 71, a first flange 72 and a second flange 73. The first flange 72 is mounted in the opening of the mounting hole 11 on the top surface of the boat body 10, and the second flange 73 is mounted in the opening of the mounting hole 11 on the bottom surface of the boat body 10. The boat body 10 is generally made of leather or plastic, and the surfaces of the first flange 72 and the second flange 73 are also generally wrapped with leather or plastic, so that the two are fixedly connected in a manner such as crimping or bonding. The mounting tube 71 are also fixed in the mounting hole 11, both end of the mounting tube 71 are respectively inserted into the first flange 72 and the second flange 73. The bottom of the swing joint 50 is provided with a plug-in rod 51, the top of the rudder 30 is provided with a mating tube 31. The plug-in rod 51 and the mating tube 31 are in disassembly fixed connection.

Specifically, The mating tube 31 is inserted into the mounting tube 71, the plug-in rod 51 is inserted into the mating tube 31, the outer wall of the plug-in rod 51 is provided with several grooves, the inner wall of the mating tube 31 is provided with several ribs, each of the ribs contains in one of the grooves to cooperate with each other. When the swinging handle 40 rotates to drive the swinging joint 50 to synchronously rotate, the mating tube 31 and the rudder 30 are driven to synchronously rotate by matching the ribs and the grooves. It should be understood that the rudder 30 and the swinging joint 50 can be synchronously and rotatably connected in a plurality of manners. Without departing from the spirit and principle of the present invention, all changes, modifications, replacements, and variations made by persons skilled in the art shall belong to the scope of protection of the present invention.

The size of the first flange 72 is the same as the that of the second flange 73.

The connection mechanism 60 includes a first connecting hole 61, a second connecting hole 62, a screw 63 and a nut 64, the first connecting hole 61 is arranged at the first end 41 of the swinging handle 40, the second connecting hole 62 passes through the swinging joint 50. The swinging joint 50 is provided with a mounting slot 53 cooperated with the first end 41 of the swinging handle 40, the mounting slot 53 divides the second connecting hole 62 into two separated parts. Pick up the swinging handle 40 to align the first end thereof to the mounting slot 53 in the swinging joint 50 and insert therein, then align the first connecting hole 62 with the second connecting hole 62, then pick up the connecting screw 63 to align with the second connecting hole 62 and insert therein, and the connecting screw 63 passes through a part of the second connecting hole 62, the first connecting hole 61 and the other part of the second connecting hole 62 on the other side. Then, pick up the nut 64 to rotatably fix on the surface of the connecting screw 63, thereby fixing the swing handle 40 and the swing connector 50, and the swing handle 40 also can be disassemble with the swing connector 50. In addition, the hole diameter of the first connecting hole 61 is the same as that of the second connecting hole 62, the diameter of the nut 64 is greater than the hole diameter of the first connecting hole 61. The first end 41 of the swinging handle 40 is tightly attached to the groove wall of the mounting groove 53, and the swinging handle 40 is rotated to drive the swinging joint 50 to rotate synchronously.

Figure 9:
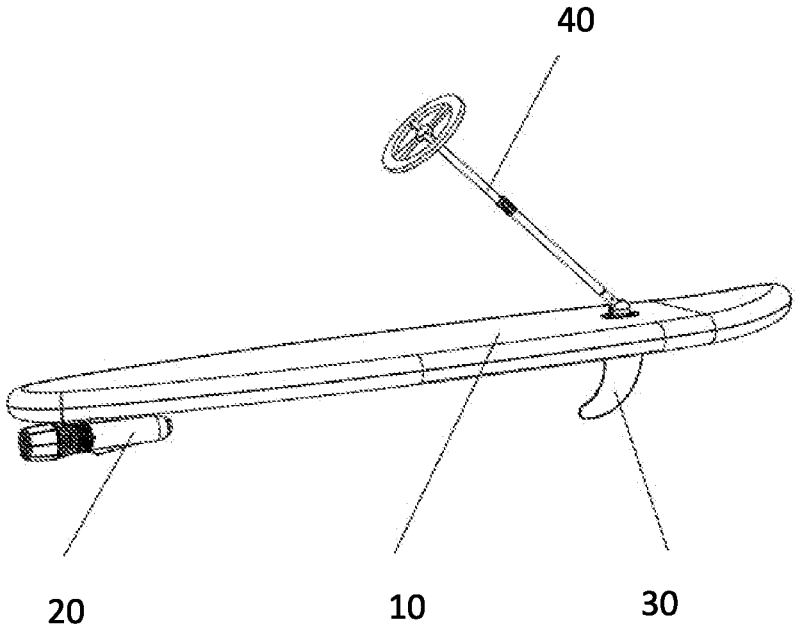
FIG. 9 is a schematic view of one end of the swing handle being fixed to the rudder according to an embodiment of the present invention.
Figure 10:
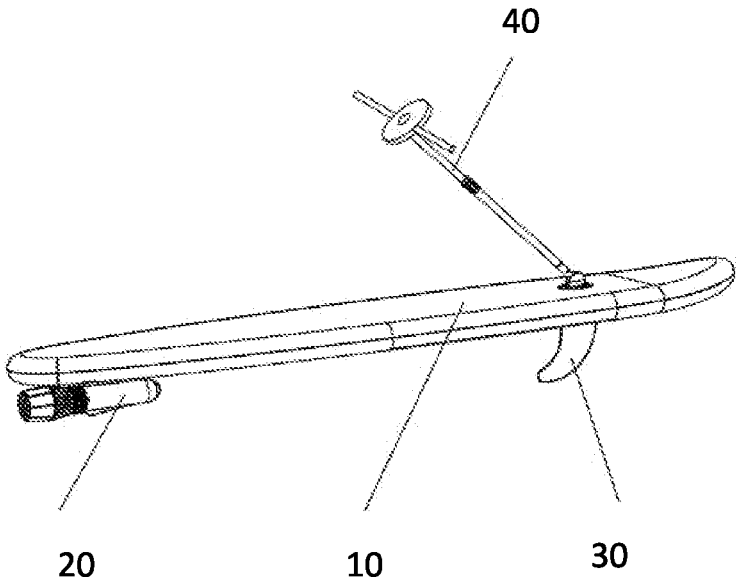
FIG. 10 is a schematic view of the other end of the swing handle being fixed to the grips according to an embodiment of the present invention.

The second end 42 of the swinging handle 40 is fixed with a handle 43, respectively fixed on both sides of the second end 42 of the swinging handle 40. Hold the handle 43 can bring the swinging handle 40 to rotate. The surface of the swinging handle 40 is provided with anti-slip patterns, having the function of preventing slippage. The handle 43 can also be a steering wheel 43*a* or a friction bracket handshake 43*b*, as shown in FIGS. 9 and 10.

Figure 8A:
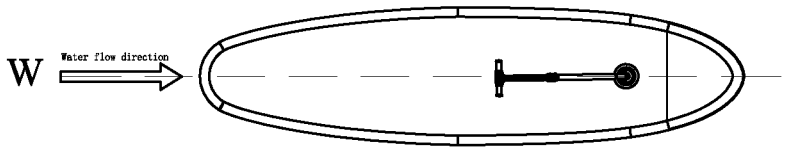
FIG. 8 *a*-8*f* is principle diagram of the power steering device for inflatable boat according to an embodiment of the present invention.
Figure 8B:
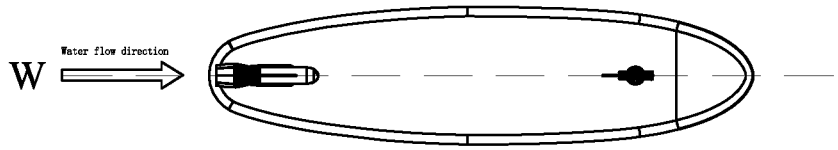
Figure 8C:
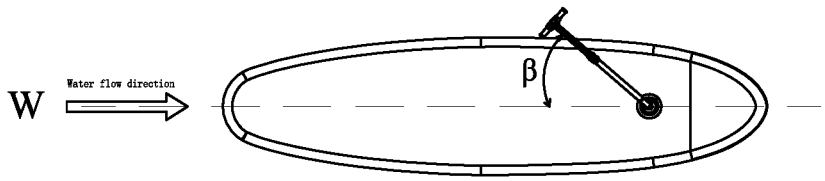
Figure 8D:
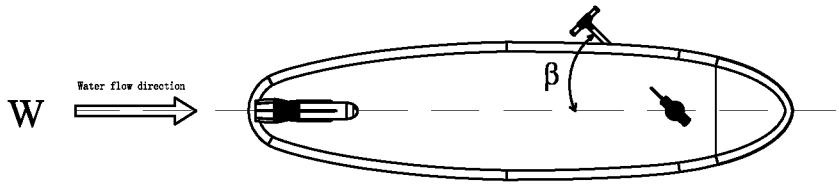
Figure 8E:
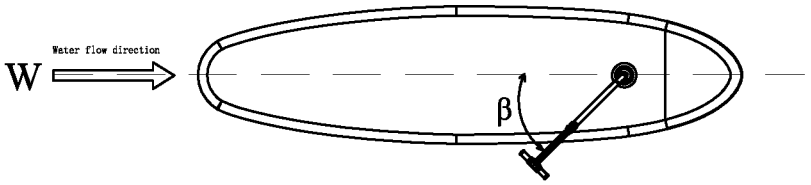
Figure 8F:
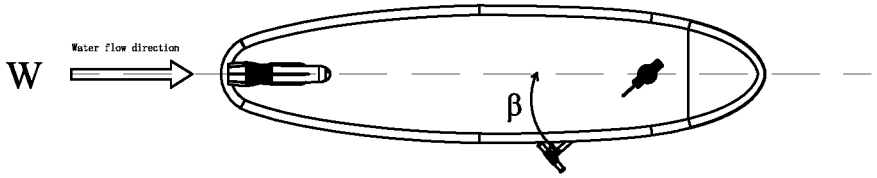

The working principle: the power steering device for inflatable boat is used in the field of the air-filled waterborne product, the underwater propeller supply power for the power steering device for inflatable boat. Rotate the swing handle 40 to drive the swing joint 50 to rotate, then the swing joint 50 drives the rubber 30 to rotate, thereby changing the direction of the rudder 30, that is. Referring to FIGS. 8*a* and 8*b*, when the swing handle 40 is aligned with the center line W of the boat body 10, the angle between the rudder 30 and water dividing angle of the rudder 30 is 0. As shown in FIGS. 8*c* and 8*d*, when the swing handle 40 is rotated by an angle β to the left along the center line W of the boat body 10, the angle between the rudder 30 and the center line W of the boat body 10 is β. As shown in FIGS. 8*e* and 8*f*, when the swing handle 40 is rotated by an angle β to the right along the center line W of the boat body 10, the angle between the rudder 30 and the center line W of the boat body 10 is β. In this way, the boat body can be turned, the balance and safety of the boat body can be ensured, and the resistance of the water is reduced.

It should be noted that, in this specification, relational terms such as first and second are only used to distinguish one entity or operation from another entity or operation, and do not require or imply any actual relationship or sequence between these entities or operations. Furthermore, the terms "include", "comprise", or any other variant thereof are intended to cover a non-exclusive inclusion, so that a process, a method, an article, or a device that includes a series of elements not only includes those elements, but also includes other elements that are not explicitly listed, or further includes elements inherent to the process, the method, the article, or the device. An element limited by "including a . . . " does not exclude other same elements existing in a process, a method, an article, or a device that includes the element, unless otherwise specified.

Although embodiments of the present invention have been shown and described, it would be appreciated by those skilled in the art that changes, modifications, alternatives and modifications can be made to these embodiments without departing from the principle and spirit of the present invention, and the scope of the present invention is defined by the appended claims and their equivalents.

The invention claimed is:

1. A power steering device for inflatable boat, comprising a boat body, an underwater propeller is fixed on one side of a bottom surface of said boat body, a rudder is arranged on the other side of said bottom surface of said boat body, and a swinging handle is provided on a top surface of said boat body, a swinging joint is fixed to one end of said swinging handle, and said swinging joint and said swinging handle are connected by a connection mechanism, said boat body is provided with a mounting hole passed through said boat body, and said rudder and said swinging joint are respectively mounted two openings of said mounting hole, and said rudder is fixed to said swinging joint so as to rotate synchronously;

wherein said rudder and said swing joint are fixed by a mounting mechanism arranged at said mounting hole, said mounting mechanism includes a mounting cylinder, a first flange and a second flange; said first flange is mounted in one opening of said mounting hole on said top surface of said boat body, and said second flange is mounted in the other opening of said mounting hole on said bottom surface of said boat body; a mounting tube are also fixed in said mounting hole, both end of said mounting tube are respectively inserted into said first flange and said second flange; a bottom of said swing joint is provided with a plug-in rod, a top of said rudder is provided with a mating tube; said mating tube is inserted into said mounting tube, said plug-in rod is inserted into said mating tube, said plug-in rod and said mating tube are in a disassembly fixed connection.

2. The power steering device for inflatable boat according to claim 1, wherein said connection mechanism includes a first connecting hole, a second connecting hole, a screw and a nut; said first connecting hole is arranged at a first end of said swinging handle, said second connecting hole passes through said swinging joint; said swinging joint is provided with a mounting slot cooperated with said first end of said swinging handle, said mounting slot divides said second connecting hole into two separated parts; said connecting screw passes through a part of said second connecting hole, said first connecting hole and the other part of said second connecting hole, thereby fixing said swing handle and said swing connector.

3. The power steering device for inflatable boat according to claim 2, wherein a hole diameter of said first connecting hole is said same as that of said second connecting hole, a diameter of said nut is greater than said hole diameter of said first connecting hole.

4. The power steering device for inflatable boat according to claim 2, wherein a first end of said swinging handle is tightly attached to a slot wall of said mounting slot, and said swinging handle is rotated to drive said swinging joint to rotate synchronously.

5. The power steering device for inflatable boat according to claim 1, wherein a second end of said swinging handle is fixed with a handle.

6. The power steering device for inflatable boat according to claim 5, wherein a surface of said swinging handle is provided with anti-slip patterns.

* * * * *